United States Patent [19]

Swink

[11] Patent Number: 4,753,495

[45] Date of Patent: Jun. 28, 1988

[54] MERCHANDISING STAND

[76] Inventor: Michael A. Swink, 3944 Chelsea Common, Tucker, Ga. 30084

[21] Appl. No.: 9,707

[22] Filed: Feb. 2, 1987

[51] Int. Cl.[4] ..... A47F 3/10

[52] U.S. Cl. ..... 312/114; 211/163; 211/DIG. 1; 248/206.5; 248/220.3; 312/213; 312/252; 312/257 A

[58] Field of Search ..... 312/138 A, 213, 210, 312/234, 252, 257 A, 114; 248/220.3, 558, 220.4, 221.1, 221.2, 221.4, 205.2, 206.5; 211/163, DIG. 1

[56] References Cited

U.S. PATENT DOCUMENTS

| | | | |
|---|---|---|---|
| 1,624,741 | 4/1927 | Leppke et al. | 211/DIG. 1 X |
| 1,677,318 | 7/1928 | Alexander | 211/163 X |
| 1,801,453 | 4/1931 | Patterson | 211/163 |
| 2,955,239 | 10/1960 | Rouse | 211/DIG. 1 X |
| 3,204,776 | 9/1965 | Brown et al. | 248/220.4 X |
| 3,799,357 | 3/1974 | Govang | 248/220.4 X |
| 3,908,830 | 9/1975 | Skrzelowski | 248/205.2 X |
| 3,931,894 | 1/1976 | Murphy | 211/163 X |
| 4,040,520 | 8/1977 | Joaquin | 211/163 X |
| 4,296,866 | 10/1981 | Learnard | 211/163 X |
| 4,463,856 | 8/1984 | Strasser | 211/163 |
| 4,509,648 | 4/1985 | Govang et al. | 248/220.4 X |
| 4,531,645 | 7/1985 | Tisbo et al. | 312/252 X |

FOREIGN PATENT DOCUMENTS

| | | | |
|---|---|---|---|
| 1119019 | 6/1956 | France | 211/DIG. 1 |
| 306805 | 4/1955 | Switzerland | 211/163 |

*Primary Examiner*—Kenneth J. Dorner
*Assistant Examiner*—Thomas A. Rendos
*Attorney, Agent, or Firm*—James B. Middleton

[57] ABSTRACT

A merchandising stand is provided with a plurality of walls for displaying items for sale, and the walls enclose storage space that can be used for storage of additional merchandise. Adapter panels can be fixed to one or more of the walls to change the surface, and change the mounting arrangement for items for sale. With the several walls and several surfaces, a great variety of forms of merchandise can be displayed. One or more of the adapter panels may be stored within the stand. The merchandising stand includes a base allowing rotation of the stand so the merchandising stand can be placed adjacent to a wall or the like and all surfaces are viewable by a customer.

5 Claims, 1 Drawing Sheet

Fig. 1
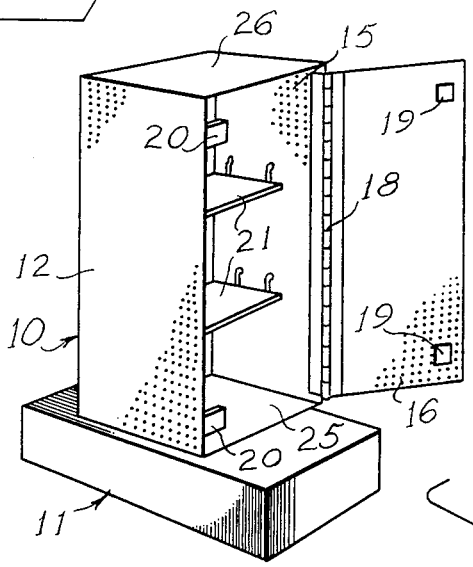
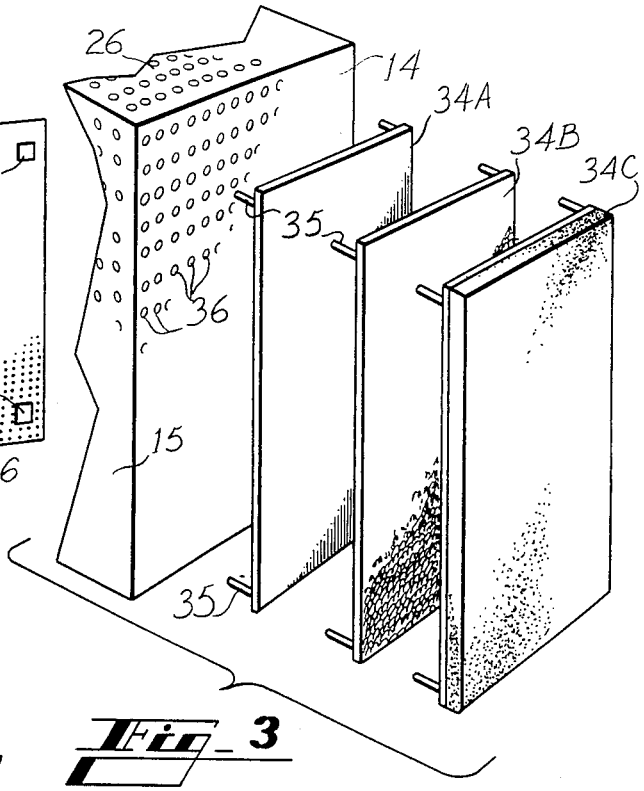
Fig. 3
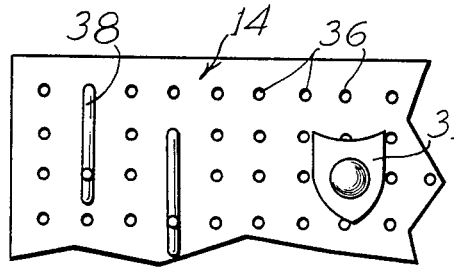
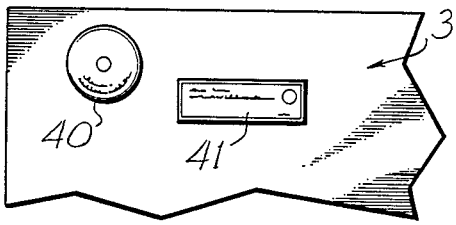
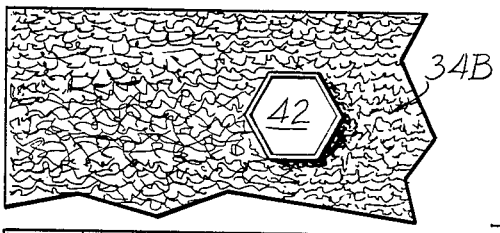
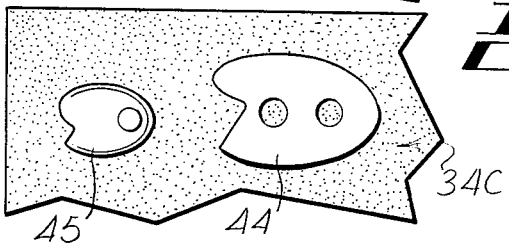
Fig. 4
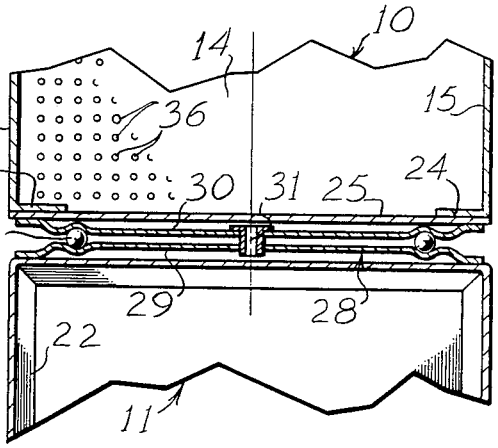
Fig. 2

MERCHANDISING STAND

INFORMATION DISCLOSURE STATEMENT

There are numerous prior art display stands, racks and the like, and many varieties are in regular use. One of the primary drawbacks to prior art display stands or merchandising racks is that the device is designed to receive one specific item, and few other items can be properly received on the rack for reasonable display. The result of this type of merchandising rack is that a small store, for example a convenience store, usually has a very large number of small merchandising racks so the display area has a cluttered appearance.

The prior art merchandising rack that is designed to receive a variety of times is usually no more than a large box, perhaps with a display banner or the like. While a large box will clearly hold a great variety of items, the items are not attractively displayed, but tend to be placed in a jumble within the box. Even if there is only one kind of item in the entire box, the item is not attractively displayed; and, if there is a plurality of different items in the box, a potential purchaser must laboriously sort through a large number of items in an effort to find the item desired.

SUMMARY OF THE INVENTION

This invention relates generally to merchandising stands, and is more particularly concerned with a merchandising stand having a plurality of display surfaces, each surface being adaptable to receive a wide variety of merchandise thereon.

The present invention provides a merchandising stand that presents a plurality of generally plane surfaces, the stand being supported by an appropriate base. Each of the surfaces is preferably perforated for receiving conventional pegboard hooks or the like. Each of the plane surfaces further may receive one of a plurality of adapter panels, each of the adapter panels having a different form of surface for receiving different forms of objects for display. Preferably, the entire display stand is rotatable for selectively displaying each of the surfaces on the stand. One of the plane surfaces may be a hinged access door so the interior of the stand serves as storage for merchandise and/or for the adapter panels.

In one embodiment of the invention, the display stand is generally rectangular, one of the four sides being a hinged door. Shelving is received within the stand, and the shelving may be supported from the inside of the display stand in the same manner that merchandise is supported on the outside. The display stand is preferably rotatable so that all of the surfaces are selectively visible, even with the display stand adjacent to a wall or other obstruction.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing one form of display stand made in accordance with the present invention, one of the walls being shown open to reveal the interior of the stand;

FIG. 2 is an enlarged, fragmentary cross-sectional view illustrating the turn-table between the stand and the base;

FIG. 3 is an exploded perspective view illustrating a plurality of adapter panels for use with the stand illustrated in FIG. 1; and, FIG. 4 is a composite view showing the surfaces of the four types of adapter panels in detail.

DETAILED DESCRIPTION OF THE EMBODIMENTS

Referring now more particularly to the drawings, and to those embodiments of the invention here presented by way of illustration, FIG. 1 shows a merchandising stand made in accordance with the present invention and including the merchandising stand 10 received on a base 11. The stand 10 is shown as rectangular in cross-section, and having a plurality of walls, or plane surfaces 12, 14 and 15. A fourth wall designated at 16 is mounted by means of a hinge 18 to the wall 15. The wall or door 16 is preferably of slightly less height than the walls 12, 14 and 15 to allow clearance for easy opening of the door 16.

It is contemplated that the stand as shown in FIG. 1 will be formed of a ferromagnetic material such as steel, and will be preferably treated to prevent rusting. It is contemplated that enamel paint will be utilized since this is both economical and attractive, but conventional metal plating of zinc, cadmium or the like may be utilized as well. To hold the door 16 closed when desired, there are magnetic catches 19 here illustrated, the catches 19 cooperating with flanges 20. It will be obvious to those skilled in the art that the separate catches 19 may take the form of a continuous magnetic strip if desired, in combination with an angle iron or the like for the flanges 20. Also, different forms of catches can be very easily utilized if desired.

The interior of the stand 10 is shown as having a pair of shelves 21. As will be more fully understood from the following description, the shelves 21 can be mounted on the walls 12, 14 and 15 by means of pegboard hooks or the like utilizing the perforations in the walls.

The base 11 is illustrated as a rectangular member, and the base 11 is preferably formed of sheet metal or the like to achieve both strength and simplicity of manufacture. Also, the stand 10 is preferably rotatable with respect to the base 11, utilizing generally conventional turn-table means.

With attention to FIG. 2 of the drawings, it will be seen that base 11 is fabricated from sheet metal, the metal being formed with flanges 22 as is conventional, and the flanges 22 can be spot welded to the surfaces as is well known in the art. Appropriate corner bracing or other reinforcing can also be utilized as desired. As is well known in the art, relatively thin metal can be utilized with additional reinforcing, or thicker metal can be utilized without the need for additional reinforcing.

It will also be seen in FIG. 2 of the drawings that the merchandising stand 10 is fabricated, but from perforated metal. By fabricating the stand 10 from sheet material, it will be readily recognized that the three walls 12, 14 and 15 can be formed from a single piece, upper and lower flanges such as the flanges 24 being turned for spot welding to the bottom plate 25. The top plate 26 shown in FIG. 1 of the drawings will be similarly attached.

Between the merchandising stand 10 and the base 11 there is a turn-table generally designated at 28. The turn-table 28 is of well known construction, and includes a lower disk 29 and an upper disk 30 rotatably fixed together by an axle 31. A ball race 32 is provided generally centrally of the turn-table 28 for easy rotation of the turn-table.

Looking now at FIG. 3 of the drawings it will be understood that the merchandising stand 10 has four plane surfaces formed of perforated material. If it is desired to have different display surfaces, an adapter panel 34 can be utilized, three adapter panels being shown in FIG. 3 and being designated as 34A, 34B and 34C. It will be seen that each of the adapter panels comprises a panel substantially the size of the plane surfaces such as the surface 14, but somewhat smaller to be received on the surface 14. Four studs 35 can be conveniently provided at the four corners of the adapter panel 34; and, the studs 35 are readily receivable through appropriate ones of the perforations in the surface 14. A nut, speed nut or other fastening means can be provided inside the stand 12 to retain the panel 34 in place.

Those skilled in the art will readily devise innumerable surfaces for display of various forms of merchandise, and the four surfaces here shown are by way of illustration only. For a full discussion of these surfaces, attention is directed FIG. 4 of the drawings.

The uppermost surface shown in FIG. 4 is designated as 14 to comport with the showing in FIG. 3, but it should be understood that the surface 14 is intended to illustrate the perforated metal of which the entire merchandising stand 10 is formed.

Since the surface 14 includes a plurality of holes 36, it will be obvious that conventional pegboard hooks 38 can be readily utilized in conventional fashion. While pegboard hooks 38 are commercially available for use on pegboards having holes spaced on one-inch centers, the surface 14 in the present invention preferably has holes 36 on one-half-inch centers. The object of this arrangement is to allow a more diverse staggering of the positions of the hooks 38 to yield a more attractive display. It will also be seen that the surface 14 includes a magnetic device 39. Since the panel 14 is formed of a ferromagnetic material, magnetic devices such as refrigerator magnets and the like can be readily displayed without additional appliances.

The next surface shown in FIG. 4 is designated 34A and comprises a solid, ferromagnetic sheet. Again magnets such as the magnets 40 and 41 can be displayed on the panel 34A. It will also be understood that hooks and other appliances that can be magnetically attached to the panel 34 can serve for the display of other forms of merchandise.

The next panel in FIG. 4 is designated 34B, and this panel is illustrated as having a teaseled surface. Any device having the hook portion of the conventional hook and teasel fasteners can be attached to the surface of the panel 34B as is illustrated by the device 42. Again, it will be obvious to those skilled in the art that hooks and other appliances having hook material can be attached to the panel 34B and used for displaying other forms of merchandise, Finally, FIG. 4 illustrates the panel 34C as having a surface of foamed material. It is known in merchandising to use a foamed surface for display of decorative pins such as the pins 44 and 45, the pin element being insertable into the foam for easy support of the decorative faces.

While the conventional foam display panel is formed of a flexible polyurethane foam, it will also be understood that an expanded polystyrene surface could be utilized for the display of objects that require more support. By way of example, objects having a wood screw as a mounting means, such as coat hooks and door stops, could be inserted into the foamed polystyrene for display, and the devices would be readily removable for purchase.

With the variety of surfaces discussed, it will be understood that virtually any form of merchandise can be supported on the merchandising stand 10, using either the original perforated surface 14 or one of the adapter panels 34. Additional merchandise can easily be stored in the interior of the merchandising stand 10, utilizing shelving such as the shelves 21 as convenient storage means. As is illustrated in FIGS. 1 and 3, the adapter panels 34 are slightly smaller than the sides, or walls 12, 14 and 15, so the adapter panels 34 can be stored within the merchandising stand 10. It may be necessary to remove the shelves 21 to store the panels, or there may be sufficient room for small shelves plus one or more adapter panels 34. If the panels 34 are small enough, it will be understood that one or more of the panels 34 might be supported on the door 16, and still allow use of shelves 21.

While the merchandise stand 10 is shown as rectangular in cross-section, those skilled in the art will understand that the same concept can be utilized with other polygons. Also, with the user of six or eight sides rather than four, each panel may be smaller to allow a wider variety of merchandise to be completely separated. In such event, the adapter panels 34 will be made the size of the walls, or somewhat less to allow mounting of the adapter panels as discussed above. Also, it will be understood that four different surfaces have been here illustrated, but numerous other surfaces could well be utilized. By way of example, it is known to utilize wood, cork, woven and non-woven fabrics, and many other surfaces. Any of these surfaces can be provided by way of an adapter panel 34, and a different adapter panel can be placed on each of the walls of the merchandising stand.

Because the merchandising stand of the present invention is rotatable, the stand can be placed against a wall, including in a corner, or at the end of a large float or other merchandising stand within a store, and all surfaces of the merchandising stand are selectively viewable by a potential customer.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention is outlined in the appended claims.

I claim:

1. A merchandising stand, for displaying a variety of selected items for sale, said merchandising stand comprising a display stand, and a base for rotatably supporting said display stand, said display stand including a plurality of generally rectangular, vertically disposed planes, said plurality of planes comprising generally solid sheet material joined at their side edges to form a regular polygonal shape, each plane of said plurality of planes constituting a display surface, each plane including a first means for receiving at least one form of item for sale, said plurality of planes defining a space within the confines of said polygonal shape, said space constituting storage space for merchandise for future display on said merchandising stand, and at least one adapter panel, said adapter panel comprising generally solid sheet material and being substantially the size and shape of each of said plurality of planes and including a second means for receiving at least one form of item for sale, means for selectively fixing said adapter panel to a selected one plane of said plurality of planes, and further including hinge means mounting one plane of said plurality of planes so that said one plane constitutes a door for access to said storage space, and catch means for maintaining said door in a closed position, said generally solid sheet material constituting said plurality of planes comprising perforated ferromagnetic material so that said planes can selectively receive a plurality of pegboard hooks and a plurality of magnets, said means for selectively fixing said adapter panel to said plane comprising a plurality of studs carried by said adapter panel and receivable through perforations in said perforated ferromagnetic material, and including at least one shelf within said storage space, and a plurality of pegboard hooks supporting said shelf from said perforated ferromagnetic material, said at least one adapter panel comprising a plurality of adapter panels, each adapter panel of said plurality of adapter panels having a different means for receiving items for sale.

2. A merchandising stand as claimed in claim 1, said means for rotatably mounting said display stand comprising a turntable received on the upper surface of said base, said turntable receiving said display stand thereon so that said display stand is rotatable on said base.

3. A merchandising stand as claimed in claim 2, one adapter panel of said plurality of adapter panels including an imperforate ferromagnetic material constituting said means for receiving items for sale.

4. A merchandising stand as claimed in claim 2, one adapter panel of said plurality of adapter panels including a foamed plastic material constituting said means for receiving items for sale.

5. A merchandising stand as claimed in claim 2, one adapter panel of said plurality of adapter panels including a teaseled material constituting said means for receiving items for sale.

* * * * *